United States Patent [19]

Crane

[11] Patent Number: 4,863,095

[45] Date of Patent: Sep. 5, 1989

[54] LUNGE WHIP FOR TRAINING HORSES

[76] Inventor: Toni C. Crane, 3748 Laguna Way, Sacramento, Calif. 95864

[21] Appl. No.: 199,773

[22] Filed: May 27, 1988

[51] Int. Cl.[4] ..... B68B 11/00

[52] U.S. Cl. ..... 231/2.1; 231/5

[58] Field of Search ..... 231/2.1, 3, 4, 5, 6; 43/18.5, 25, 44.98

[56] References Cited

U.S. PATENT DOCUMENTS

| | | | |
|---|---|---|---|
| 800,006 | 9/1905 | Bronaugh et al. | 231/5 |
| 2,766,549 | 10/1956 | Dickerson | 43/44.98 |
| 3,356,294 | 12/1967 | Henry | 231/2.1 |
| 3,799,429 | 3/1974 | Henry | 231/2.1 |
| 4,075,776 | 2/1978 | Fiebig | 43/18.1 X |
| 4,154,391 | 5/1979 | Girty | 231/3 |

FOREIGN PATENT DOCUMENTS

| | | | |
|---|---|---|---|
| 133788 | 8/1949 | Australia | 231/4 |
| 43671 | 8/1910 | Austria | 231/2.1 |

*Primary Examiner*—Robert P. Swiatek
*Attorney, Agent, or Firm*—Donald E. Nist

[57] ABSTRACT

The lunge whip for training horses is light in weight, balanced and long. It includes a main body having a number of telescoping tapering hollow tubular sections movable between a collapsed storage position and an extended operative position. The front section or sections are flexible and resilient to aid the whipping action of the whip. A long cord lash of synthetic braided non-tangling fiber such as polyester or polyamide fiber is attached by a swivel to the front end of the main body and bears a popper cord at its front end. The popper cord is preferably of sisal twine and has a front end bearing a popper tassel for audibly signaling a horse during training. The whip main body bears a pair of spaced hooks for use as cord lash winders when the whip is collapsed. The cord lash may be connected to a loop in a wire wrapped around the front end of the main body and covered with a heat shrunk sleeve. Alternatively, the front end of the main body can be embedded in a cavity in the cord lash and the assembly covered by the heat shrunk sleeve. The whip is simple, efficient, easy to handle and inexpensive.

10 Claims, 1 Drawing Sheet

LUNGE WHIP FOR TRAINING HORSES

BACKGROUND OF THE INVENTION

1. Field of the Invention

The present invention generally relates to training devices and more particularly to an improved lunge whip for training horses.

2. Prior Art

Lunge whips are used in the lunge training of horses for show purposes and the like. Most such whips are heavy and unbalanced, although they are relatively short. Their weight tends to make the trainer's whip arm tired and sore after a short period of time, thus preventing the effective use of the whip. Conventional lunge whips are generally only about five or six feet in length with a six foot cord lash attached thereto. In order to reach the horse effectively with such a whip, the horse must be moved in a small diameter circle, putting stress on the horse's legs.

There is a need for an improved lunge whip of greater than conventional length which will permit effective lunge training in a wider diameter circle, for example, fifteen to twenty meters, thus reducing stress on the horse's legs. Such an improved whip should be lighter in weight and more balanced than conventional whips and should be easy to maneuver and use without tiring the trainer's whip arm. Preferably, the improved whip should be capable of easy, compact storage without tangling the cord lash thereof. The whip should also be inexpensive, durable and efficient, and be capable of being constructed in a number of sizes and shapes.

SUMMARY OF THE INVENTION

The improved lunge whip of the present invention satisfies all the foregoing needs. The whip is substantially as set forth in the Abstract of the Disclosure. Thus, the whip has a main body formed of elongated, hollow, tubular telescoping sections tapering down forwardly to a flexible resilient front end.

A braided cord lash of synthetic kink-resistant fiber such as polyamide or polyester fiber is connected to the front end of the main body in any one of a number of ways. Thus, the cord may have a rear loop connected to a swivel, in turn connected to a wire loop in the front of the main body. The wire loop can be formed in a wire wrapped around the front section of the main body and covered by a heat shrunk plastic sleeve. Alternatively, the front tip of the main body can be embedded in a pocket in the rear of the cord lash and the assembly can be covered by a heat shrunk plastic sleeve. Still alternatively, the cord lash can be threaded forward through the front section of the main body and the rear end of the cord lash can be fire expanded so that it jams in the front section, holding the cord lash in place.

The rearwardmost of the telescoping sections bears a rear handle with hand grip and a spaced pair of hooks which serve as lash winders when the whip is collapsed. Thus, the cord lash can be kept neatly stored in a tangle-free condition.

The front end of the cord lash bears a preferably braided sisal popper cord bearing a popper tassel at its front end and a series of knots spaced along the length thereof. The popper tassel audibly signals the horse when the whip is cracked. The popper cord easily winds with the cord lash around the lash winders when the whip is stored.

The whip can be very long, for example, eight and one-half feet to eleven feet or more in main body length, with a cord lash length of ten to fifteen feet, plus a one foot long popper cord. Other dimensions are also possible. The described dimensions make possible the effective use of the whip for lunging horses in a ten to twenty meter diameter circle, thus reducing stress on the horse's legs. Although the whip is long, it is light, four to eight ounces in weight, depending on its length. The sections thereof are preferably formed of tapered, generally cylindrical fiberglass tubing.

Further features of the present invention are set forth in the following detailed description and accompanying drawings.

DRAWINGS

DETAILED DESCRIPTION

FIGS. 1, 2, 5 & 6

Figure 1:
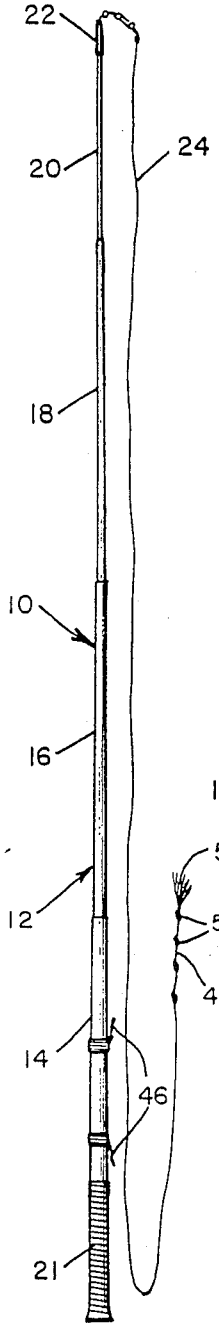
FIG. 1 is a schematic side elevation of a first preferred embodiment of the improved lunge whip of the present invention, shown with the whip in the fully extended operative position.

Now referring more particularly to FIGS. 1, 2, 5 & 6 of the accompanying drawings, a first preferred embodiment of the improved lunge whip of the present invention is schematically depicted therein. Thus, whip 10 is shown which comprises a main body 12 formed of four forwardly tapered hollow tubular telescoping sections 14, 16, 18 & 20. Sections 14, 16, 18 & 20 may be, for example, about 41", 35", 34" & 21" in length, respectively, for a total length of 11 feet. Body 12 may, for example, taper down from about $\frac{5}{8}$" diameter to about $\frac{1}{8}$" in diameter and be formed of aluminum or other light metal, fiberglass or plastic. It includes a rear handle 21 over section 14 formed of plastic, rubber, cork, etc.

Figure 5:
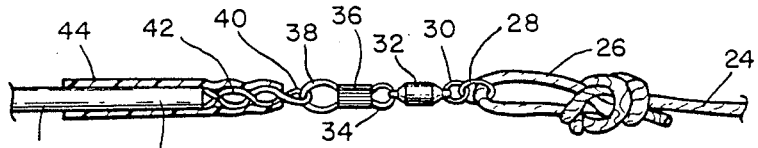
FIG. 5 is an enlarged fragmentary schematic side elevation, partly broken away, of the form of connection of the cord lash of FIG. 1 to the front section of the whip main body of FIG. 1.

The front tip 22 of section 20 is connected to a cord lash 24, preferably of $\frac{1}{8}$" braided synthetic fiber such as polyester fiber. Cord 24 may be, for example, about 15 feet in length. The particular manner of connection of cord lash 24 to tip 22 is shown in FIG. 5. Thus, the rear end of cord lash 24 is formed into a loop 26 to which is connected a split ring 28 joined to the front ring 30 of a swivel 32. Swivel 32 is in turn joined to the front ring 34 of a ring clip 36, the rear ring 38 of which is connected to a loop 40 formed in a wire 42 wrapped around the sides of tip 22, glued thereto and covered by a plastic tube 44 heat shrunk in place. Tube 44 may be of any suitable conventional heat shrinkable plastic.

Whip 10 includes a spaced pair of cord lash winders in the form of metallic hooks 46 attached to the exterior of section 14. In addition, whip 10 includes a popper cord 48 (FIG. 6), preferably about one foot in length and in the form of braided sisal cord bearing a tassel 50 at its front end and a series of knots 52 disposed along the length thereof. Knots 52 can be successively cut off to renew tassel 50, that is, form a new tassel comparable to tassel 50 as each tassel wears down in use.

Figure 2:
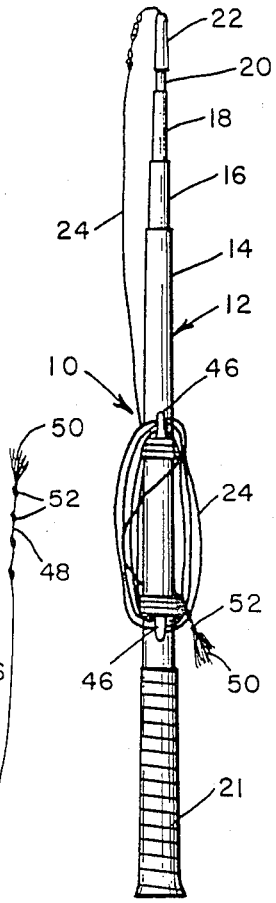
FIG. 2 is a schematic side elevation of the whip of FIG. 1 shown in the collapsed storage position.

It will be noted that whip 10 is about 8 ounces in weight compared to proportionately heavier conventional whips, yet is much easier to handle and is longer, with an overall length, including cord lash and cord popper, of about 26 to 27 feet (one foot of which is cord popper), in comparison with conventional whips of about 11½ feet in overall length. One German-made whip is very expensive and is about 24 feet in overall length but is clumsy to handle. None of the conventional whips telescope at all, much less to a compact storage position, such as is shown in FIG. 2 for whip 10. Cord lash 24 and cord popper 48 wind up easily on hooks 46 for non-tangling neat storage. Whip 10 is inexpensive, durable, efficient and easy to use and store.

FIGS. 3 & 4

Figure 3:
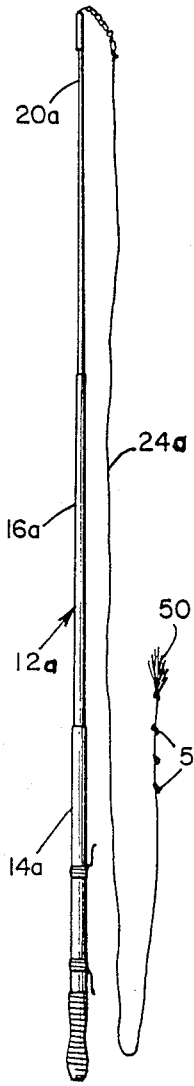
FIG. 3 is a schematic side elevation of a second preferred embodiment of the improved lunge whip of the present invention, shown in the fully extended operative position; .
Figure 4:
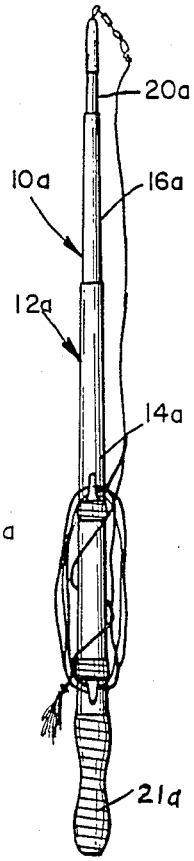
FIG. 4 is a schematic side elevation of the whip of FIG. 3 shown in the collapsed storage position.

A second preferred embodiment of the improved whip of the present invention is schematically depicted in FIGS. 3 & 4. Thus, whip **10*a* is shown. Components thereof similar to those of FIGS. 1, 2, 5 & 6** bear the same numerals but are succeeded by the letter "a".

Whip **10*a* is identical to whip 10**, except as follows:

(a) there are only 3 telescoping sections **14*a*, 16*a* and 20*a* instead of 4 sections, with sections 14*a*, 16*a* and 20*a* being of 37", 33" and 33" length, respectively, for an overall length of body 12*a*** of 8 feet 6 inches, and an overall whip weight of 4 ounces;

(b) handle **21*a* is of slightly different shape than handle 21; and, (c) cord lash 24*a*** is about 10 feet in length instead of 15 feet.

All other advantages of whip 10 are present in whip **10*a***.

FIG. 7

Figure 7:
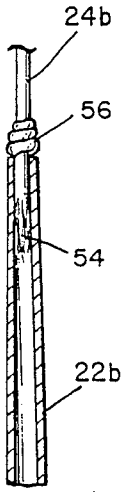
FIG. 7 is an enlarged schematic fragmentary side elevation, partly in section, of an alternate manner of interconnecting the cord lash and main body of the whip of the present invention; and, FIG. 8 is an enlarged fragmentary schematic side elevation, partly in section, of another manner of interconnecting the cord lash and main body of the whip of the present invention.
Figure 6:
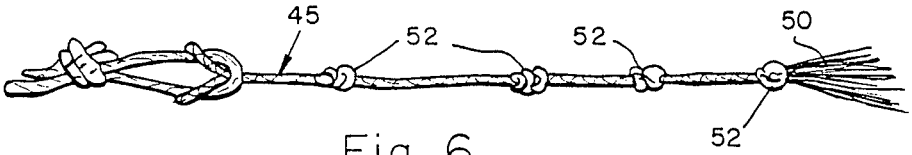
FIG. 6 is an enlarged fragmentary schematic side elevation of the interconnection of the cord lash and popper cord of the present invention.

An alternate manner of connecting the cord lash to the front tip of the main body is shown schematically in FIG. 7. Components similar to those previously designated in FIGS. 1 through 6 bear the same numerals but are succeeded by the letter "b". Thus, cord lash **24*b* can be passed through hollow tip 22*b*. The rear end 54 of cord lash 24*b* is shown in a flame expanded condition causing it to easily jam inside tip 22*b* to hold cord lash 24*b* in place. A knot 56 can be placed in cord lash 24*b* and immediately in front of tip 22*b* to prevent cord lash 24*b* from retracting into tip 22*b***.

FIG. 8

Figure 8:
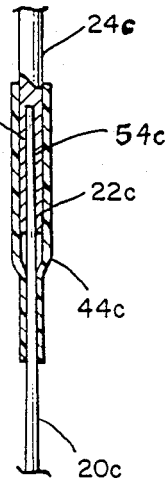

Another manner of interconnecting the cord lash and front tip is shown in FIG. 8. Components similar to those previously designated in FIGS. 1 through 6 bear the same numerals but are succeeded by the letter "c". Thus, in this instance, the rear end **54*c* of cord lash 24*c* bears a pocket 58 in which the greatly reduced (in diameter) tip 22*c* of section 20*c* is embedded and preferably glued in place and over which a sheath or tube 44*c*** of plastic is heat shrunk to seal the components in place.

Various other modifications, changes, alterations and additions can be made in the improved whip of the present invention, its components and parameters. All such modifications, changes, alterations and additions as are within the scope of the appended claims form part of the present invention.

Prior Art Statement

No prior art search has been conducted on the subject matter of the present claimed whip invention. However, applicant knows of no relevant prior art. The closest prior art whip comes in two non-telescoping sections, and is not constructed similar to the present whip nor does it have the advantages thereof. Accordingly, it is believed that the whip of the present invention is clearly patentable thereover.

What is claimed is:

1. An improved lunge whip for training horses, said whip comprising, in combination:

a. a main body comprising a plurality of elongated telescoping tubular sections moveable between a collapsed compact storage position and an extended operative position, the rearwardmost of said sections bearing a handle, said sections being tapered down toward the front end of said main body; and, b. an elongated cord lash connected at its rear end to said front end of said main body; said cord lash's rear end bearing a central cavity in which the front tip of the forwardmost of said sections is glued, and said rear end of said cord lash and the exposed front end of said forwardmost section being covered by a heat shrunk plastic sheath to anchor said cord lash to said section.

2. The improved whip of claim 1 wherein said whip includes a popper cord connected to the front end of said lash cord for audibly signaling a horse during lunge training of said horse, said popper cord including a popper tassel at its front end.

3. The improved whip of claim 2 wherein one of said sections bears a spaced pair of lash winders on the outer surface thereof.

4. The improved whip of claim 3 wherein said lash winders comprise a spaced pair of hooks.

5. The improved whip of claim 3 wherein said sections are cylindrical and thin walled to minimize whip weight and wherein the forwardmost of said sections is flexible and resilient to facilitate whipping action.

6. The improved whip of claim 2 wherein said cord lash is of braided plastic fiber and is tangle resistant, wherein said sections are of at least one of aluminum, fiberglass and plastic to minimize weight and wherein said popper comprises braided sisal twine having a popper tassel at the front end thereof and spaced knots along the length thereof.

7. The improved whip of claim 2 wherein there are a total of four of said sections with an overall length of said main body of about 11 feet, wherein said cord lash is of polyester fibers and its length is about 15 feet and wherein said popper is about 1 foot in length.

8. The improved whip of claim 2 wherein there are a total of three of said sections, with an overall length of about eight and one-half feet, wherein said cord lash is of polyamide fibers and is about 10 feet long and wherein said popper is about 1 foot in length.

9. An improved lunge whip for training horses, said whip comprising, in combination:

a. a main body consisting essentially of a plurality of elongated telescoping tubular sections moveable between a collapsed compact storage position and an extended operative position, the rearwardmost of said sections bearing a generally cylindrical handle, said sections being tapered down toward the front end of said main body; and, b. an elongated cord lash connected at its rear end to a loop of a wire protruding from said front end of said main body, the remainder of said wire being wound around the forwardmost of said sections, with a plastic sleeve heat shrunk over said wire remainder to hold said wire in place on said main body.

10. The improved whip of claim 9 wherein one end of a snap swivel is clipped to said wire loop and the other end of said snap swivel is connected by a split ring to a loop in the rearwardmost end of said cord lash.

* * * * *